United States Patent [19]

Bowman

[11] 4,269,385

[45] May 26, 1981

[54] SECTIONAL INGOT MOLD

[76] Inventor: Harold M. Bowman, 18867 North Valley Dr., Fairview Park, Ohio 44126

[21] Appl. No.: 3,093

[22] Filed: Jan. 15, 1979

Related U.S. Application Data

[63] Continuation-in-part of Ser. No. 699,650, Jun. 24, 1976, abandoned, which is a continuation-in-part of Ser. No. 600,060, Jul. 29, 1976, abandoned.

[51] Int. Cl.[3] ..... B22D 7/08

[52] U.S. Cl. ..... 249/82; 249/163; 249/165; 249/168; 249/174

[58] Field of Search ..... 249/82, 174, 163, 165, 249/168

[56] References Cited

U.S. PATENT DOCUMENTS

| | | | |
|---|---|---|---|
| 354,742 | 12/1886 | Sabold | 249/82 |
| 1,438,677 | 12/1922 | Weymerskirch | 249/82 |
| 1,491,881 | 4/1924 | Perry | 249/174 X |
| 2,028,243 | 1/1936 | Perry et al. | 249/174 |
| 2,071,906 | 2/1937 | Stevens | 249/174 |

FOREIGN PATENT DOCUMENTS

| | | | |
|---|---|---|---|
| 966058 | 3/1950 | France | 249/174 |

*Primary Examiner*—Robert D. Baldwin
*Attorney, Agent, or Firm*—Baldwin, Egan, Walling & Fetzer

[57] ABSTRACT

A sectional ingot mold formed of a plurality of side wall sections which when assembled define at least the side periphery of a mold cavity, with means coacting on the side wall sections for coupling the wall sections together into an integral unitary ingot mold; said means, providing for automatic compensation for expansion and retraction of the mold assembly sections when molten metal is poured into the ingot mold by providing for expeditious expansion of the mold assembly sections with respect to one another while aiding in sealing the mold sections from leakage of molten metal during the pouring and cooling of the ingot in the mold. In certain embodiments, yieldable gasket material is disposed between the wall sections at their junctions for aiding in preventing leakage of molten metal from the ingot mold assembly during pouring and solidification of an ingot in the mold. The interior surface of each mold section may be sinuous for aiding in stress relief of the formed ingot while aiding in reducing external skin cracks of the ingot or leakage of molten metal from the mold and/or the interior of the newly formed ingot.

20 Claims, 23 Drawing Figures

SECTIONAL INGOT MOLD

This is a continuation-in-part patent application of pending U.S. patent application of Harold M. Bowman, Ser. No. 699,650, filed June 24, 1976 and entitled "Sectional Ingot Mold", now abandoned, which in turn is a continuation-in-part patent application of Ser. No. 600,060, filed July 29, 1976 (now abandoned).

This invention relates to a sectional ingot mold and more particularly to a reusable sectional ingot mold of improved construction and functionability. The embodiments show sectional ingot molds formed of a plurality of side wall sections, which when assembled, define a mold cavity, with means to connect the side wall sections together to provide automatic compensation for expansion and retraction of the side wall ingot mold sections when molten metal is poured into the ingot mold. During the pouring operation of molten metal into the mold, the connecting means allow for expeditious expansion of the mold sections, with respect to one another, while aiding in sealing the respective mold sections from leakage of molten metal during the pouring and cooling of the ingot in the mold. In certain embodiments yieldable gasket means are disposed between the coacting mold sections for aiding in preventing leakage of molten metal from between the mold sections during pouring of the ingot, in which the gasket material is adapted for expeditiously compensating for expansion and contraction of the mold during the pouring of the ingot and subsequent cooling thereof. In other embodiments, no gasket material is required.

BACKGROUND OF THE INVENTION

Sectional ingot molds are known in the prior art. U.S. Pat. No. 496,736 issued May 2, 1893 to C. Hodgson and U.S. Pat. No. 1,224,277 issued May 1, 1917 to F. Clarke, are examples of known sectional mold constructions. U.S. Pat. No. 354,742 in Dec. 21, 1886 to J. Sabold, and British Pat. No. 13,446 of A.D. 1900 in the name of Stephen Appleby, et al and entitled "Improvements In or Connected With Ingot Molds", disclose sectional mold arrangements embodying means for relieving stress on the fastening bolts thereof due to the expansion of the molten metal. However, such prior art sectional molds have not always been satisfactory, due at least in part to oftentimes leakage of molten materials occurring between the mold sections during the pouring of the molten metal into the mold cavity and subsequent solidification of the metal, or due to the complexity and/or costs of such arrangements.

H. S. Lee and Amos E. Chaffee in U.S. Pat. No. 1,584,954, issued May 18, 1926 identified Permanent Mold Distortion and its control by using thermally responsive insert elements to effect control of a permanent mold leaking molten metal along the parting line and to avert distortion or a bowing action of the mold by placing higher or lower coefficient of expansion metals in position in the mold to resist the inward or outward movement of the mold thus directly effecting the casting being formed and produced by the permanent mold.

U.S. Pat. No. 158,696 to Foster et al discloses a sectional mold in conjunction with spring-loaded bolts to provide for lateral expansion of the mold sections relative to one another during the expansive force of the molten metal poured into the mold.

To this and other prior art involving sectional molds, none have possessed fastener means for connecting mold wall sections together to form a mold cavity, while providing for automatic compensation, and including memory, to allow for expansion and retraction of the mold assembly sections when molten metal is poured into the ingot mold by providing for expeditious expansion of the mold sections with respect to one another while aiding in sealing the mold sections from leakage of molten metal during the pouring and cooling of the ingot in the mold.

Additional disclosures of the prior art of both sectional and one piece cast ingot mold and ingot assemblies reveal exhaustive patent work and issuance of over 80 patents by Emiel Gathmann beginning with U.S. Pat. No. 921,972 issued May 18, 1909 through to U.S. Pat. No. 2,290,804, issued July 21, 1942. Patents were issued almost every year by Gathmann and some years had two patents or more issued, indicating great in-depth knowledge and work on ingot molds and mold assemblies for over 34 years. From this and other patent endeavors no solution was found to the problem of extending ingot mold life and preventing mold leakage while simplifying ingot mold production by sectionalizing, and allowing for automatic expansion and retraction of mold sections during pouring of molten metal into the mold and the subsequent cooling cycle, as taught in the present application.

SUMMARY OF THE INVENTION

The present invention provides a novel sectional ingot mold construction wherein the mold is comprised of a plurality of separable mold sections defining a mold cavity and having means on the mold sections adapted for coupling the sections together into an integral mold. The interior cavity forming surfaces of the mold sections may be sinuous substantially throughout their extent, although other configurations such as straight smooth interior surfaces of sectional molds, and the like can be utilized. In certain embodiments, yieldable gasket means are disposed between the coacting mold sections for aiding in preventing leakage of molten metal from between the mold sections during pouring of the ingot, in which the gasket material is adapted for expeditiously compensating for expansion and contraction of the mold segments during molten metal pouring. In other embodiments no gasket material is used, while connecting means coupling the ingot mold sections together provide automatic compensation for expansion and retraction of the mold assembly wall sections.

Accordingly, an object of the invention is to provide a novel sectional ingot mold.

Another object of the invention is to provide a sectional ingot mold with means to couple the sections together to form a mold cavity; coupling means providing for automatic compensation for expansion and retraction of mold assembly sections while providing expeditious expansion of mold sections when molten metal is poured into the mold, with resulting action of quick heat dissipation from the mold due to air passing between and around each mold section.

A still further object of the invention is to provide a sectional mold in accordance with the above which includes a sinuous configuration on the interior surface of the mold sections, for aiding relieving "as cast" stress surface cracks and metal leakage in the resultant ingot, and aiding in preventing leakage of molten metal from the mold.

A still further object of the invention is to provide a sectional ingot mold which has laterally projecting flanges on the mold sections adapted for receiving fastener means for coupling the mold sections together into an integral mold defining an ingot mold cavity, and with said fastener or coupling means possessing memory and automatically compensating for expansion and retraction of the mold assembly during the pouring operation on the mold assembly, and subsequent heating and cooling thereof.

Other objects and advantages of the invention will be apparent from the following description taken in conjunction with the accompanying drawings, wherein:

DESCRIPTION OF PREFERRED EMBODIMENTS

Figure 1:
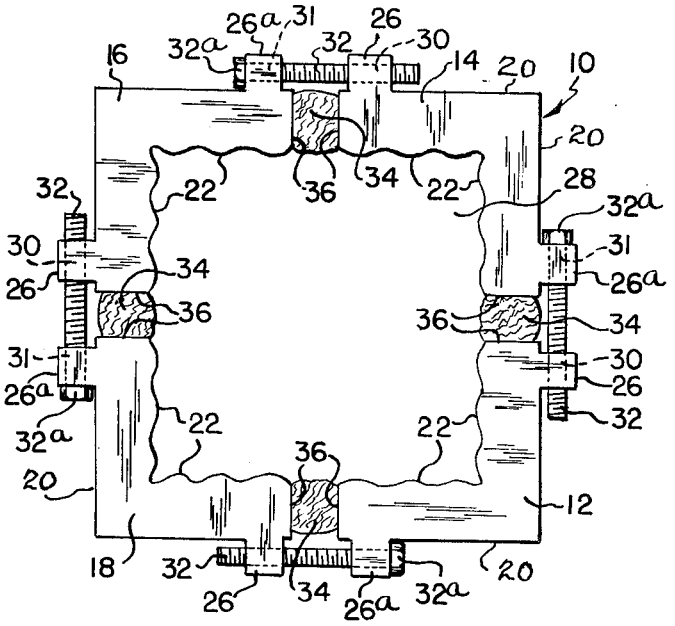
FIG. 1 is a top plan view of a sectional ingot mold constructed in accordance with an embodiment of the invention.
Figure 2:
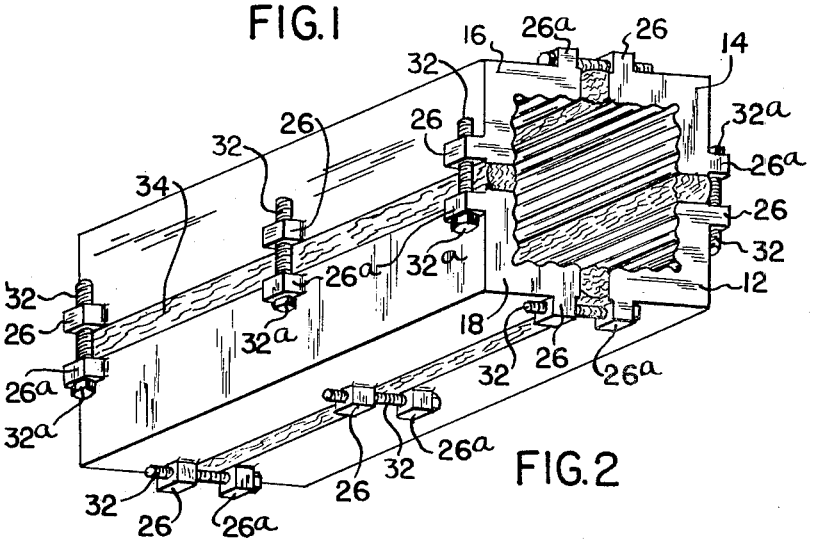
FIG. 2 is a generally perspective view of the ingot mold of FIG. 1.
Figure 3:
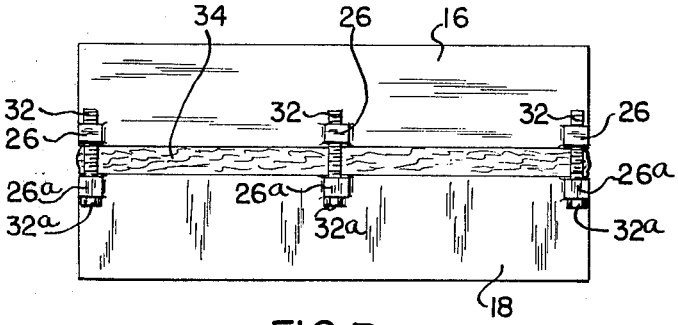
FIG. 3 is an elevational view of the ingot mold illustrated in FIGS. 1 and 2.

Referring now again to the drawings and particularly to FIGS. 1, 2 and 3, there is illustrated an ingot mold 10. Such ingot mold, in the embodiment illustrated, comprises mold sections 12, 14, 16 and 18 coupled together. Each of sections 12, 14, 16 and 18 may have smooth exterior wall surfaces 20 and generally wavelike or sinuous interior surfaces 22. Surfaces 22 are adapted to facilitate stress relief in the ingot as cast; while aiding in reducing external skin cracks or actual leakage of molten metal from the interior of the newly formed ingot or from the mold assembly cavity.

Each mold section, in the embodiment illustrated, includes laterally projecting lugs or ears 26, **26*a* disposed adjacent the correspnding end thereof. As can be best seen in FIG. 1, each of the lugs is adapted to coact with a generally complementary lug on the adjacent mold section, for coupling the mold sections together into an integral ingot mold defining a mold cavity 28. In the embodiment illustrated, one of the lugs (e.g. 26) on each mold section has a threaded opening 30 therethrough while the other of the lugs 26*a* preferably has a non-threaded opening 31 therethrough aligned with the confronting opening 30, and adapted to receive therein a threaded fastener member 32, such as a bolt, which when coacting in threaded relation with the respective threaded opening 30 in lug 26, applies force to the mold sections to draw them together. Fastener 32 may include a head 32*a* for limiting movement of the associated fastener in one direction with respect to the corresponding lug 26*a*. Fastener 32 preferably has a slip fit in opening 31**. Other fastener means instead of threaded fasteners, might be utilized.

In accordance with certain embodiments, a yieldable gasket 34, preferably formed of fire or heat resistant material, is inserted between the confronting end faces of the adjacent mold sections, and upon predetermined threaded tightening of the fasteners 32, the gaskets are squeezed to form a liquid-tight seal between the mold sections. Gaskets 34 prevent molten metal from leaking out of the junctures between the mold sections during pouring of the ingot, and provide for expansion of the mold sections with respect to one another during heating occasioned by the pouring operation and the casting of an ingot. Gaskets 34 may be formed of any suitable fire and heat resistant material.

Referring to FIG. 2, it will be seen that the lugs 26, **26*a* are spaced along the full height of the ingot mold and preferably are adjacent the top and bottom extremities thereof as well as located generally centrally between the top and bottom extremeties. This ensures uniform and effective compression of the gasket material upon tightening of the associated fasteners 32**, to provide a positive seal between the mold sections.

As illustrated, the mold made may be open from end to end thereof, and during pouring of an ingot, may be set for instance in a sand area or on a base plate or "stool" (not shown) for furnishing the bottom for the mold. The mold sections may be formed of any suitable material, but steel or cast iron is conventionally utilized. It will be seen that in the event of breakage or the wearing out of one mold section, that another section can be readily substituted for the broken or worn out section, so that the entire mold does not have to be replaced. Moreover, the sectional construction with coupling means provides for expansion and contraction of the mold sections during heating and cooling, and aids in eliminating stresses and strains found in one-piece or unitary molds.

Other examples of suitable gasketing materials are mixtures of asbestos fibers and fire clays of a consistency that the gasket can maintain their own form, but which are yieldable upon application of predetermined force thereto. Such gasketing material is relatively economical and expendible, and therefore once the ingot mold is poured and the ingot has solidified, upon removal of the ingot from the mold as by opening of the mold by deactuation of the fastener means 32, the gasket material is thrown away. Upon reassembly of the mold sections, new gaskets can be inserted between the confronting end faces 36 of adjacent mold sections.

Figure 4:
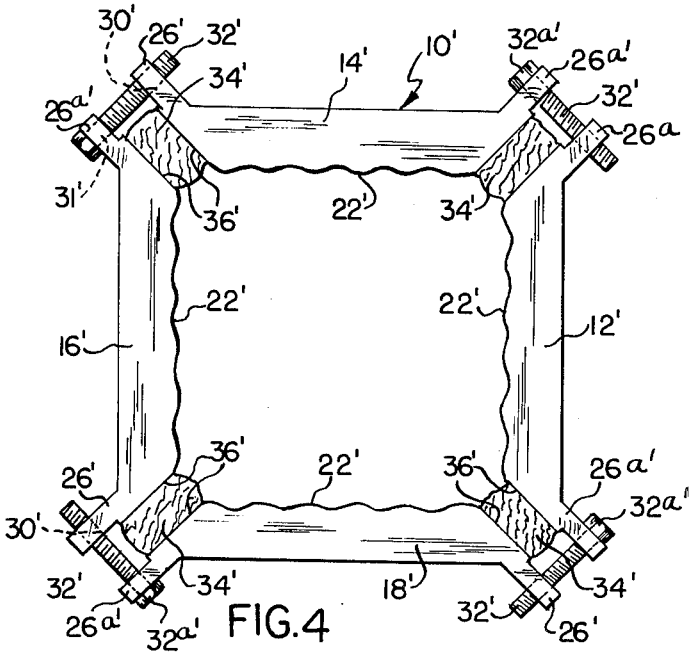
FIG. 4 is a top plan view of another embodiment of ingot mold wherein the mold sections are joined at the corners thereof.
Figure 5:
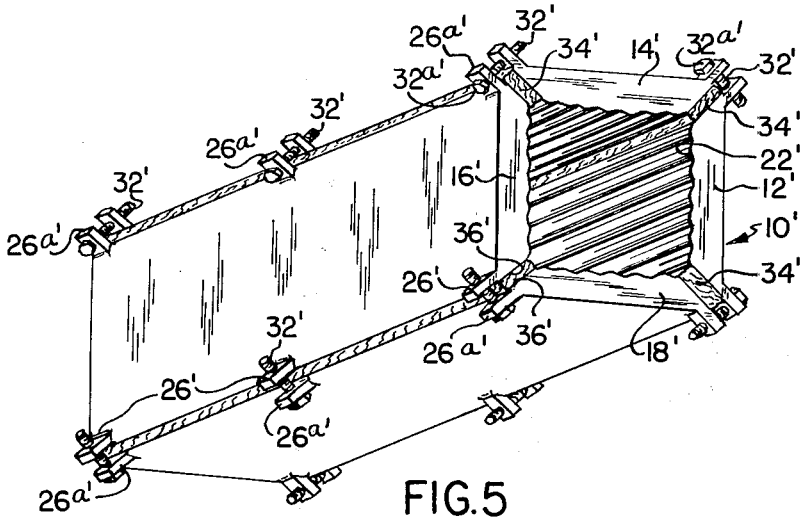
FIG. 5 is a generally perspective view of the ingot mold illustrated in FIG. 4.

Referring now to FIGS. 4 and 5, there is shown a further embodiment of the invention wherein the mold 10' has gaskets 34' disposed between mitered end faced 36' of the mold sections 12', 14', 16' and 18'. However, in this embodiment, the junctures between the mold sections and the location of the gaskets are at the corners of the mold, rather than intermediate the corners, as in the first described embodiment. Moreover, the flange means 26', **26*a*' which receive the fasteners 32'** likewise are disposed at the corners of the mold. In other respects, this arrangement is generally similar to the first described embodiment.

Figure 6:
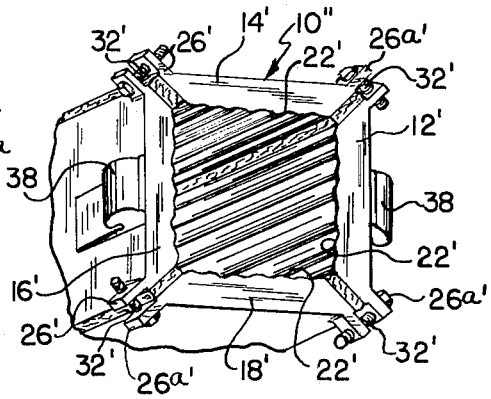
FIG. 6 is a fragmentary perspective view of the upper end of an ingot mold and embodying a modification as compared to the mold of FIGS. 4 and 5.

Referring now to FIG. 6, there is illustrated a further embodiment of mold 10'' which in effect is generally similar to that of the FIGS. 4 and 5 embodiment, but wherein there is provided lugs or projections 38 at the upper end portion of the respective mold, with such lugs appearing on at least certain of the mold sections, and adapted for lifting purposes so that once the ingot has solidified, the mold can be raised as for instance by a crane or the like, utilizing a lift chain about the lugs 38, and shaken, to shake the ingot out of the mold. If the mold is of open bottom construction, the ingot will slide out of the bottom of the mold. If it turns out that the solidified ingot cannot be dislodged from the mold, then the mold sections can of course be opened after sufficient cooling, by loosening of fasteners 32', to separate the mold sections and provide for removal of the ingot.

Figure 7:
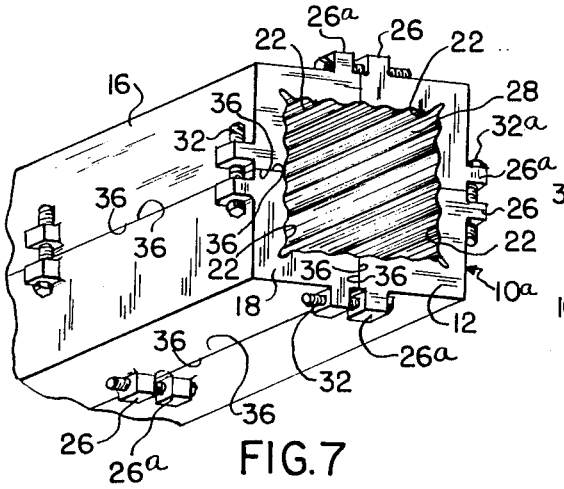
FIG. 7 is a fragmentary, perspective view of a sectional ingot mold of the general type of FIG. 1, but wherein no gasket means is utilized at the junctures of the mold sections.

FIG. 7 illustrates a mold **10*a* generally similar to that of the FIGS. 1 and 2 embodiment, except that when assembled to define the mold cavity 28, no yieldable gasket material is disposed between the confronting substantially planar surfaces 36 of the mold sections. Such surfaces engage in flat surface-to-surface engagement, and in conjunction with coupling means for automatic compensation for expansion and retraction of the mold sections and preferably a sinuous configuration of the interior surfaces 22** of the mold, will prevent leakage of molten metal from the mold and will relieve expansion stresses for the sectional mold wall themselves.

Referring now to FIGS. 8 through 11, there is disclosed another embodiment of ingot mold formed of separable sections 12'', 14'', 16'', and 18''. The side ends of each such mold section is provided with laterally projecting flanges or lugs 26'', **26*a*''. Each of the lugs or flanges 26'', 26*a*'' is adapted for abutting engagement as at 40, with the confronting flange or lug of the adjacent mold section, to define the ingot mold cavity 28. Flanges or lugs 26'', 26*a*'' preferably extend the full height of the respective mold section, as illustrated, and embody spaced sections 42 of reduced size for a purpose to be hereinafter set forth. The interior surface of each mold section is preferably wave-like or sinuous similarly to the previously described embodiments, or they can be straight and smooth surfaced, and lifting lugs 38'** may likewise be provided on the respective mold section, for lifting or raising the mold as heretofore described.

Clip members 44 of generally C-shaped configuration in plan (FIG. 9) are provided for coaction with the adjacent flange or lug portions 26'', **26*a*'' for clamping the mold sections together into an integral mold assembly. Each clip 44 is formed of metal and comprises a body portion 46, and arm portions 47 projecting laterally from said body portion in generally converging relation with respect to one another, as can be best seen in FIG. 9**, with the arm portions being adapted to clasp the adjacent flange or lug of the mold section therebetween in coupling relation.

Body portion 46 is preferably provided with a generally planar abutting surface 50 adapted for surface-to-surface engagement with the generally flat faces 52' of the adjacent flanges or lugs of the mold assembly. The clips are inserted into the reduced size section 42 of the flanges, with the arm portions being readily received in encompassing relation to the reduced size sections 42, and then the clips are moved or driven into tight coacting relation with the wider portions of the flanges, for clamping the mold sections tightly together. As can be seen, the vertical gripping faces 52 of the clips are preferably tapered (FIG. 10) for facilitating their movement from the reduced size section 42 of the flanges into tight coacting relation with the wider portions of the coacting flanges. This taper may be in the order of 4° to 5°, but is shown in exaggerated form for illustrative purposes.

The mold sections 12'', 14'', 16'' and 18'' may be formed for instance of grey cast iron, while the clips may be formed of stabilized austenitic stainless steel. A suitable type of stainless steel material for use for the clips is that known as RA-330 stainless, purchaseable from Rolled Alloys, Inc. of Detroit, Mich. and described in its present bulletin identified as No. 107. Stabilized austenitic stainless is characterized by having a relatively high nickel content, with the stainless steel material having relatively low rates of thermal conductivity as compared to, for instance, carbon steels, and possessing elasticity to return back to its original condition after it has been heated up to a relatively high temperature (e.g. 2200° F.). In other words, this material has "memory" which causes it to return to substantially its original condition after cooling thereof. "Memory" as used herein, and in the hereinafter set forth claims, means the ability of the fastener means material of the mold assembly to return to substantially its original preheated size condition and to retain its important physical properties, after undergoing thermal stress and other stress (e.g. hydrostatic stress) at temperatures to which the fastener means is subjected upon the pouring of molten metal into the mold cavity to form an ingot, and the resultant heating and subsequent cooling thereof.

The modulus of elasticity of RA-330 stainless steel is approximately $28.5\times10^6$ psi at room temperature to approximately $19.5\times10^6$ psi at 1600° F. The mean coefficient of thermal expansion in the 70° F. to 200° F. range is approximately 8.3 in./in./°F.$\times10^{-6}$. In comparison, grey cast iron (Grade 30) has a modulus of elasticity of approximately $15\times10^6$ psi at room temperature and a mean coefficient of thermal expansin of approximately 6 in./in./°F.$\times10^{-6}$ in the 32° F. to 212° F. range.

The clips initially resist the opening movement of the cast iron wall sections of the ingot mold at their junctures, but do not prevent their opening as the thermal expansion continues in the mold wall segments; then as heat is further conducted to the clips, the expansion of the clips continues, the latter (clips) opening or expanding at a faster rate than the expansion of the mold wall sections, due to the higher coefficient of thermal expansion of the clips. The result is that the cast iron walls are allowed to expand at their normal thermal expansion rate as dictated by the molten metal poured into the mold, while being held in assembled relationship to one another by the clip fasteners. It is possible to utilize metal fastener clips that have a lower, the same as, or higher mean coefficient of thermal expansion than that of the sectional mold assembly walls. The difference would be the amount of speed of opening action or tension required for the mold assembly, or desired in the resistance of the fastener means in allowing the sectional ingot mold assembly walls to expand or open in relationship to one another at the junctures of the mold side wall sections.

Figure 8:
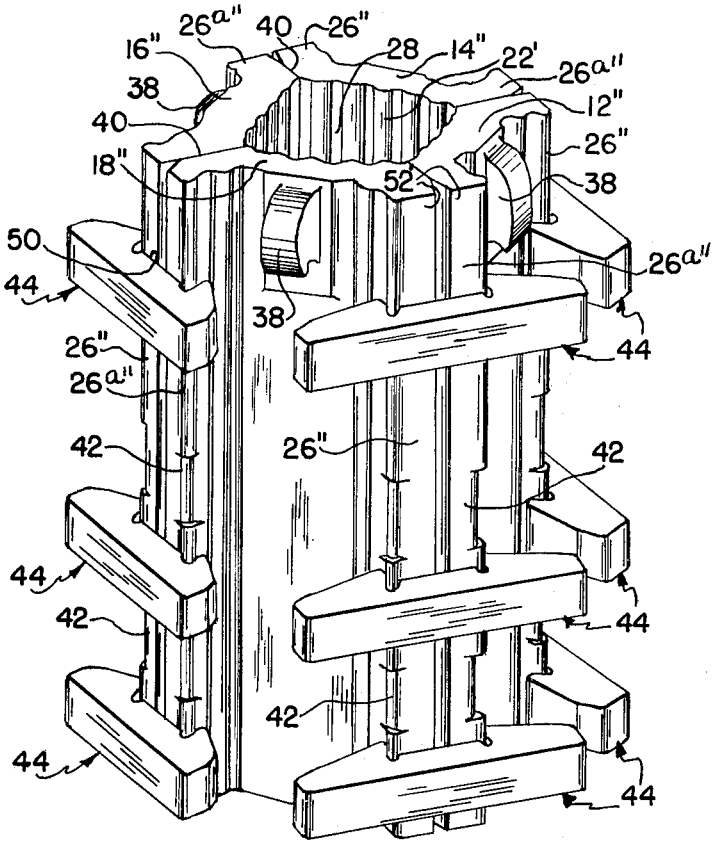
FIG. 8 is a perspective view of another embodiment of sectional ingot mold, wherein the coupling means holding the mold sections together into an integral mold defining cavity are so constructed and arranged to automatically compensate for expansion and retraction of the mold assembly during the pouring operation and subsequent cooling.
Figure 9:
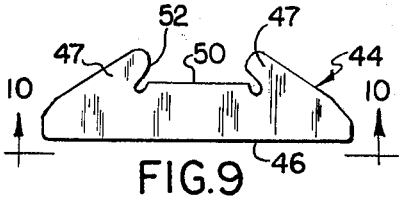
FIG. 9 is a reduced size top plan view of one of the clips used to couple the mold sections together in the FIG. 8 assembly.
Figure 10:
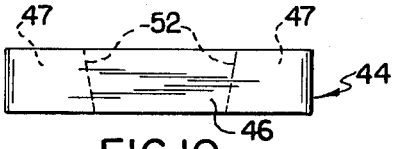
FIG. 10 is an elevational view of the clip of FIG. 9 taken generally along the plane of line 10—10 of FIG. 9, looking in the direction of the arrows.
Figure 11:
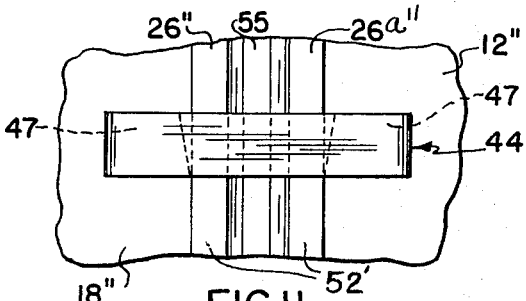
FIG. 11 is a fragmentary, elevational view of the FIG. 8 mold showing separation of the mold sections due to the heating of the mold upon pouring the ingot.

Referring now to FIG. 11, there is diagrammatically illustrated a fragment of an adjacent pair of flanges of the mold assembly of FIG. 8 wherein the mold has been heated by pouring a charge of molten metal thereinto which results in a substantial raising of the temperature of the mold. The molten metal poured into the mold may be at a temperature of for instance 2800° F. to 3000° F. The resultant relatively rapid heating of the mold sections causes the wall sections to expand. This expansion is aided and abetted by the hydraulic pressure of the molten metal in the mold. The material of the clips 44 can have a lower, same as, or higher coefficient of thermal expansion as compared to the material of the mold sections, and they too expand due to the heating up of the mold including the flange portions 26'', **26*a*''. As shown in FIG. 11, the mold sections visibly expand as the ingot commences to solidify, actually causing the flanges to separate and with actual visible spaces 55 of $\frac{1}{8}$ to $\frac{1}{4}$ inch opening up between the adjacent flanges 26'', 26*a*'' of the mold assembly. The molten metal does not flow out of these spaces 55** because the metal has formed a skin as the mold flanges separate due to air that circulates between and around the wall sections, thus solidifying the ingot metal at the open junctures of the mold walls and preventing the molten metal in the interior of the mold cavity from flowing out. However, gases that may exist in the molten metal in gaseous form can escape during this expansion of the mold sections relative to one another due to the thermal elevation. The clips, because they expand at various rates as compared to the material of the mold sections at least initially resist, but do not prevent, the expansion of the mold sections and opening or separation of the junctures thereof, and sufficiently so that the mold assembly maintains its assembled relationship; the molten metal within the mold cavity solidifies into an ingot considerably faster than in a conventional, one piece, cast ingot mold.

It is believed that the homogeneous physical and chemical structure of the resultant ingot is aided in the faster cooling of the ingot in the sectional mold assembly of the present invention, and the quick cooling effect on the outside walls of the ingot creates thicker cooled walls faster. This aids in reducing "Rimming" and other effects of internal gases inside an ingot, and chemical solidification, piping, blow holes, are reduced by this relatively quick cooling action.

As the mold cools, the ingot cools and shrinks along with the shrinking of the mold sections, and eventually a substantially abutting relationship between the confronting surfaces of the mold section flanges, as at 40, once again returns, with the clips generally tightly holding the mold sections together. Thus, it will be seen that the clips 44 initially resist the opening movement of the mold wall sections, opening as the thermal expansion continues in the metal mold wall sections and then generally expanding at their rate of mean coefficient of thermal expansion at the temperature thereof in a manner to hold the wall sections in assembled relationship to one another, and once the mold cools down to a predetermined temperature, the clip contract back to substantially their original size and shape in clasping relation to the mold sections.

Removal of the ingot from the mold can be accomplished either by lifting it with the lifting lugs 38' on a crane and shaking or pushing the ingot out, or by, if need be, removal of the clips thereby permitting separation of the mold sections and ready removal of the ingot. The action of the clips permits relatively rapid reuse of the mold upon removal of the ingot.

Figure 12:
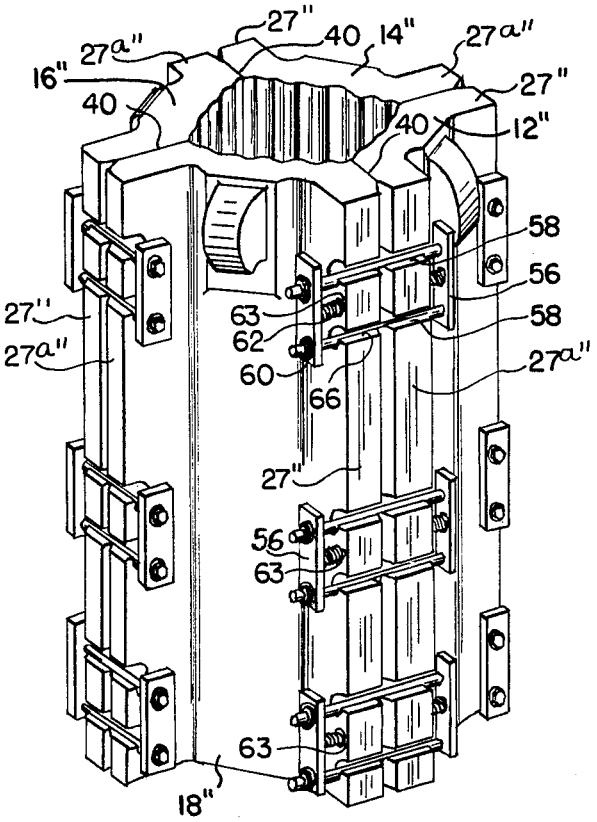
FIG. 12 is a perspective view of a further embodiment of sectional ingot mold embodying coiled spring means for permitting expansion and retraction of the mold assembly sections and subsequent to the pouring operation of the mold.

Referring now to FIG. 12 there is shown a further embodiment of expansible mold assembly. In this embodiment, the coupling or fastener means for fastening the mold sections together comprises abutment plates 56 disposed on opposite sides of each of the adjacent flange portions 27'', **27*a*'' with stringer means which in the embodiment illustrated comprise threaded bolts 58, extending between the abutment plates 56 and being provided with adjustable nuts 60, for tightening and loosening thereof, thereby providing for relative movement of the plates toward or away from one another. Spring means 62 formed of heat resistant material, such as for instance stainless steel, are provided coacting between the respective abutment plate and the confronting flange (either 27″ or 27***a*″) and it will be seen that upon tightening up of the nuts 60, the springs are compressed, thus urging the flange portions 27″, 27*a*″ together into tight engaged relation, as at 40, similar to the FIG. 8 embodiment. An opening or recess 63 can be provided in the respective flange for locating the spring with respect to the flange and with respect to the associated abutment plate.

Upon pouring of the molten metal into the mold, the mold sections 12″, 14″, 16″ and 18″ expand, and the fastener arrangement including the springs are compressed, thereby resisting the separation of the flange portions. A skin of material solidifies over the open or spaced flange portions as they slowly spread apart and preferably in combination with a sinuous wall configuration of the respective mold sections, prevents the leaking of the molten metal from the mold. Upon solidification and cooling of the mold, the ingot contracts and the springs 62 urge the flange portions of the mold back toward engaged relation.

The ingot can then be removed from this type of mold in the same manner as aforedescribed, and the mold can be reused for another pouring operation. The springs are preferably formed of stabilized austenitic stainless steel and possess sufficient elasticity and memory to permit the separation of the mold sections during the thermal expansion, yet urge the flanges on the mold sections to return to generally abutting relation upon cooling of the ingot and the mold.

As can be seen, the flanges are preferably provided with slots or recesses 66 therein which receive therethrough the aforementioned stringers 58 and thus ensure the retention of the fastener assembly on the mold irrespective of whether or not the nuts 60 are tightened so as to place a compression force upon the springs 62.

Referring now in particular to FIGS. 13 to 21, lab studies and tests of the afordescribed sectional mold assembly of the general type of FIGS. 8–11 have revealed data which is included herein as follows:

These test experiments utilized an approximately one-fifth (1/5) scale (as compared to a conventional size one piece ingot mold for casting steel ingots) sectional ingot mold. The mold wall sections were of grey cast iron; class 30, possessing a coefficient of thermal expansion of approximately 6 in./in./° F.$\times 10^{-6}$ in the 32° F. to 212° F. temperature range. The clips 44′ that held the ingot mold wall sections together (FIG. 13) were comprised of RA-330 stainless steel from aforementioned Rolled Alloys Inc. having a mean coefficient of thermal expansion of approximately 8.3 in./in./° F.$\times 10^{-6}$ in the temperature range of 70° F. to 200° F.

Figure 13:
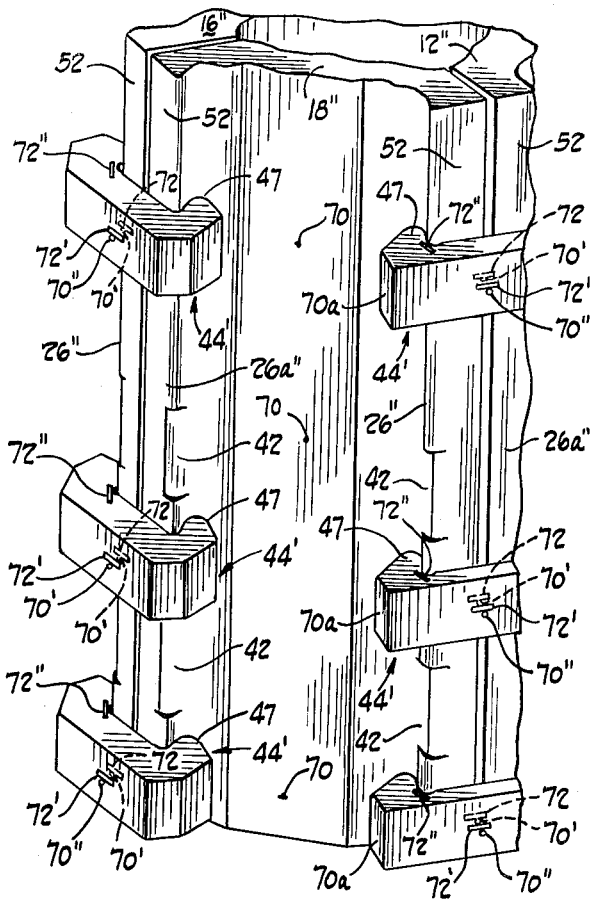
FIG. 13 is an enlarged, fragmentary view generally similar to FIG. 8, but showing the approximate positions of thermocouples on the walls of the mold sections and the approximate positions of strain gages and thermocouples on the coupling clips of the mold, which were used in tests to measure respectively the temperature changes of the mold section walls and the stresses and temperature changes in the clips during the pouring of molten metal into the mold and for a predetermined time subsequent thereto.

In these experiments, temperatures and stresses were measured by means of thermocouples e.g. 70, 70′, 70″ and 70*a*, and strain gages e.g. 72, 72′ and 72″ which were mounted on one of the mold body sections, and on the clips 44′ assembled with corner flanges on the mold (FIG. 13). Strain gage measurements on the clips were a direct measure of thermal and hydrostatic stresses experienced by the 4-piece sectional mold during the ingot molding. The strain gages were positioned as shown in FIG. 13 with their long axis generally perpendicular with respect to the vertical axis of the ingot mold. The strain gages were types BLH-FSM-High Temperature design (nickel-chromium alloy), and were attached with PLD 700 high temperature cement. Although FIG. 13 illustrates for exemplary purposes instrumentation of a plurality of mold section junctures, in actual test, the top, middle and bottom clips of only one mold section juncture was instrumented for the test purposes.

Figure 21:
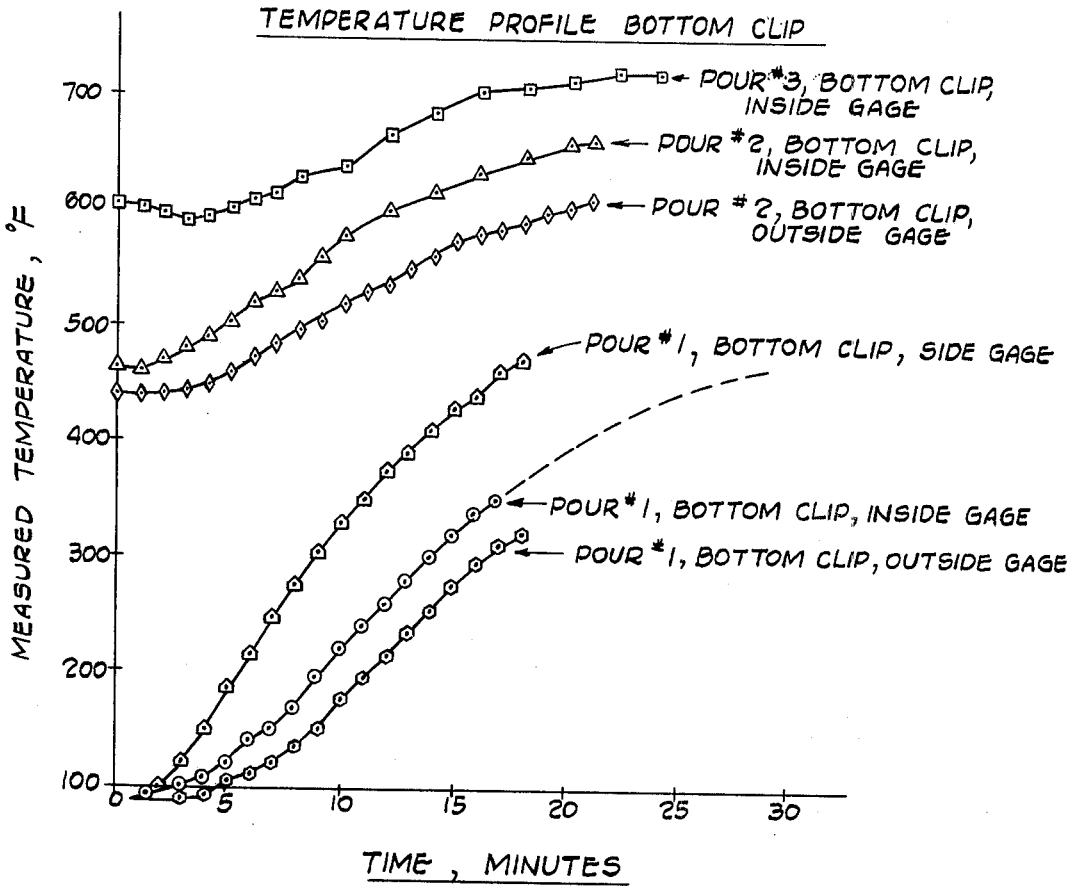

Referring to FIG. 21, temperature measurements on the clips showed that during pour No. 1 of molten steel into the mold assembly, the bottom clip reached the highest measured temperature approximately 475° F. between 15 and 20 minutes from the commencement of the pour. The mold wall temperature measurement by thermocouples 70 (FIG. 14) indicate that the mold sections started to lose temperature 15 to 20 minutes from the commencement of a pour. The top clip measured the next highest temperature (approximately 450° F.) while the middle clip registered the lowest temperature (approximately 375° F.). These temperature measurements were those recorded by the side gages 70*a* on the clips. The mold wall temperature readings (FIG. 14) taken on a vertical center line of one segment at the outer surface showed the mid-height section to have the highest measured temperature (approximately 1200° F.) followed by the bottom wall section and then the top wall section.

Figure 15:
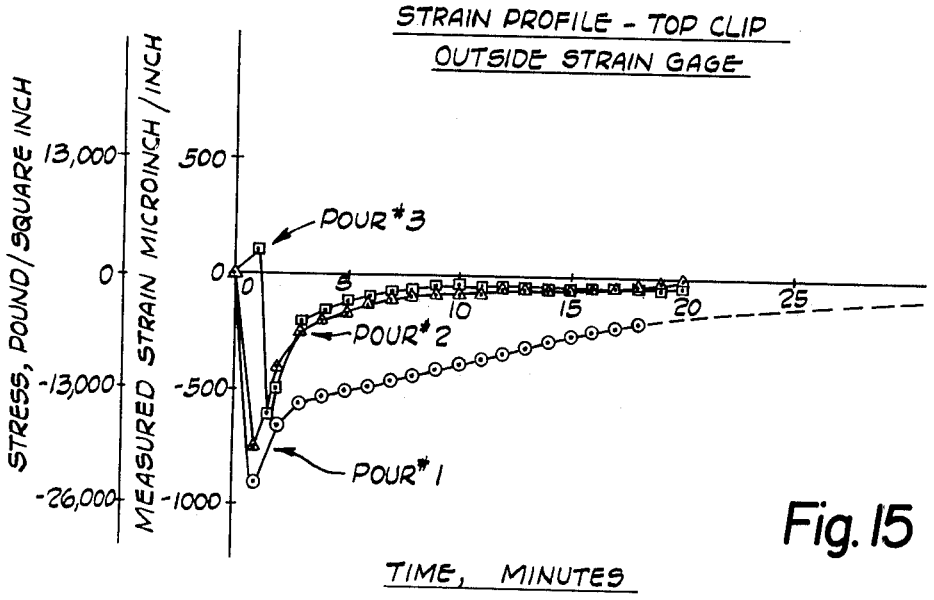
FIG. 15 is a graph illustrating a composite strain profile for the outer side of the top clips of a FIG. 13 type test arrangement, as recorded by the outer strain gages on the clips during three consecutive ingot pours into the mold assembly.

Referring to FIG. 15 which illustrates the "outside" stress (in compression) on the top clip (as measured by strain gage 72′) it will be seen that the top clip was initially subjected to considerable stress upon the initial pouring of the molten metal into the mold assembly cavity (illustrating for example a stress of approximately 24,000 psi for pour No. 1 within approximately one minute from commence of the pour) thus illustrating that the clip initially resisted opening or separation of the juncture surfaces. However, as the heat is transferred to the clips from the mold wall sections, the stress fairly rapidly dropped whereupon at about 10 minutes from commencement of the pour of for instance pour No. 1, the "outside" stress in compression on the top clip had dropped to about 9000 psi. Accordingly, as heat is transferred to the clip fasteners, the latter open or expand at a faster rate than the expansion of the mold wall sections, to allow the junctures of the latter to open with resultant application of lower stress to the wall sections by the resistance to opening or expansion of the clips. Accordingly, it will be seen that the clips initially expanded at a lesser rate as compared to the material of the mold sections upon pouring of molten metal into the mold cavity, to resist opening of the mold section junctures, but then as more heat was transferred to them, they expanded at a faster rate to reduce the resistance to separation of the mold section juncture surfaces. However, by this time the molten metal at the juncture surfaces has "skinned" over or sufficiently solidified to prevent leakage of molten metal from the mold.

Figure 17:
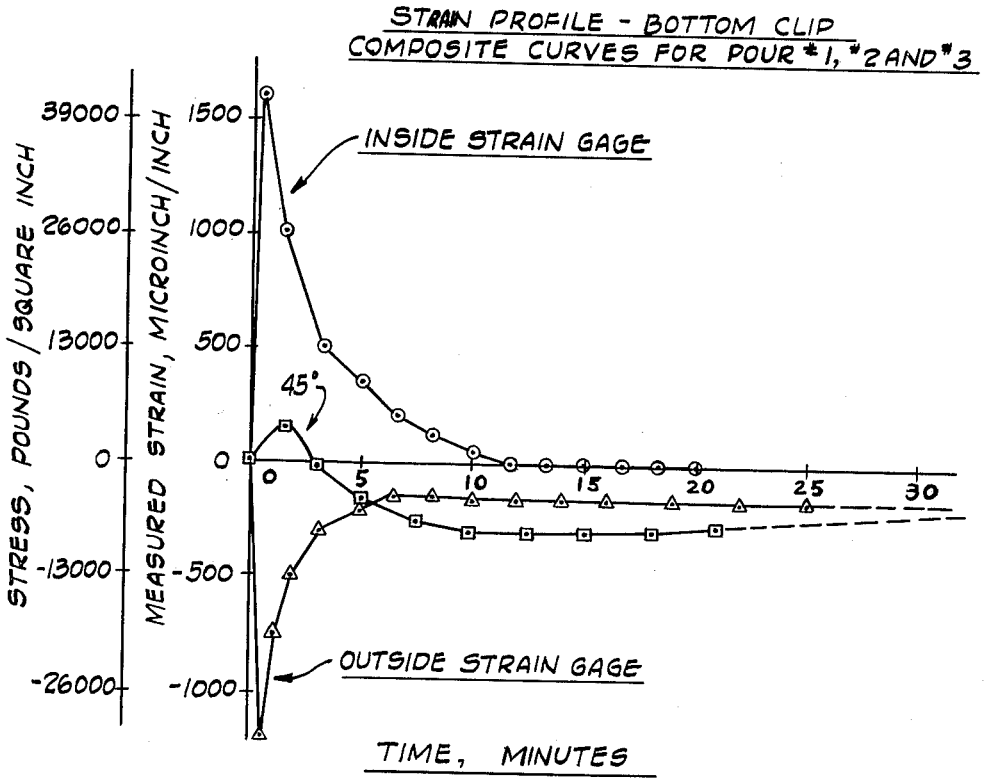
FIG. 17 is a graph similar to FIG. 16, but showing the composite strain profiles for a bottom clip of a FIG. 13 test arrangement type during the aforementioned three consecutive ingot pours.
Figure 19:
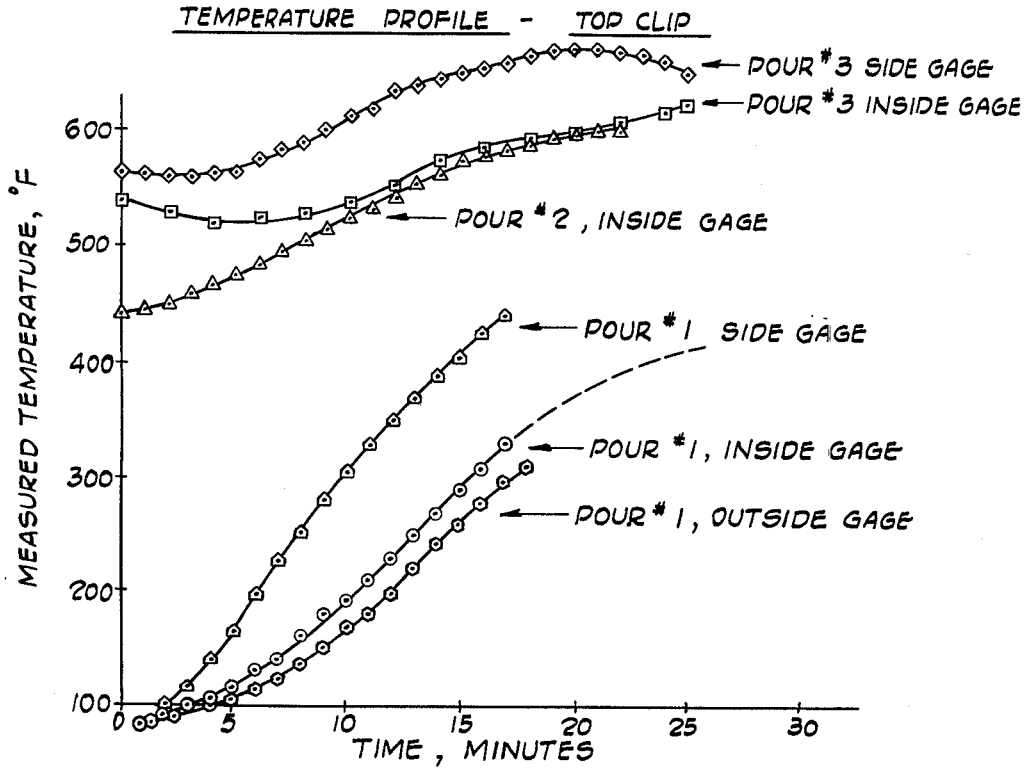
FIG. 19 is a graph of the temperature profile of a top clip of a FIG. 13 type test arrangement for the aforementioned three ingot pours of molten metal into the test mold assembly, indicating the progressive increase in temperature of the top clip after predetermined time periods for the three pours.
Figure 20:
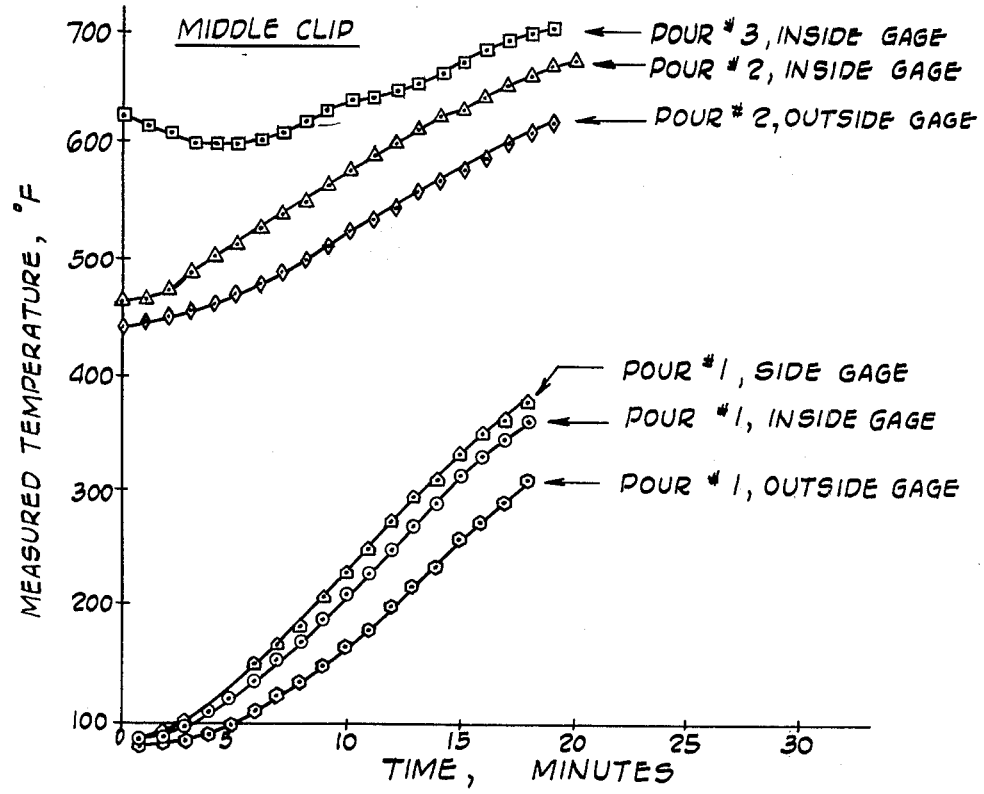
FIGS. 20 and 21 are graphs generally similar to that of FIG. 19 but illustrating the temperature profiles during the aforementioned three ingot pours for respectively a middle and a bottom clip.

FIG. 17 illustrates composite curves of three pours for the "inside" stress (tension) of the bottom clip (as measured by strain gage 72) the "outside" stress (compression) of the bottom clip (as measured by strain gage 72′) and the "corner" or 45° stress of combined tension and then compression (as measured by strain gage 72″). Here again, considerable stress occurs in the bottom clip upon initial pouring of the molten metal into the mold assembly cavity which drops off fairly rapidly as heat is transferred to the clip fasteners, and the rate of expansion of the latter increases to cause resultant reduced stress on the mold wall sections as the junctures of the latter separate, but, while maintaining the mold wall sections in assembled relation.

Figure 16:
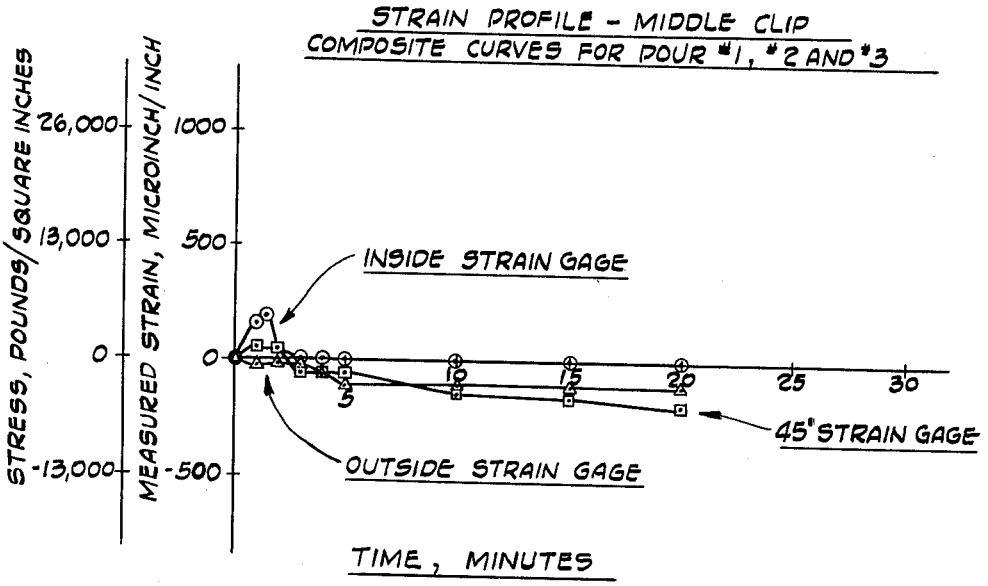
FIG. 16 is a graph illustrating composite strain profiles of the inner side, the outer side and the angular corner area (identified as 45° strain gage) of the middle clips of a FIG. 13 type test arrangement during the aforementioned ingot pours, and as recorded by the respective strain gages.

FIG. 16 illustrates the same situation with the middle clip, but to a generally lesser extent.

Figure 18A:
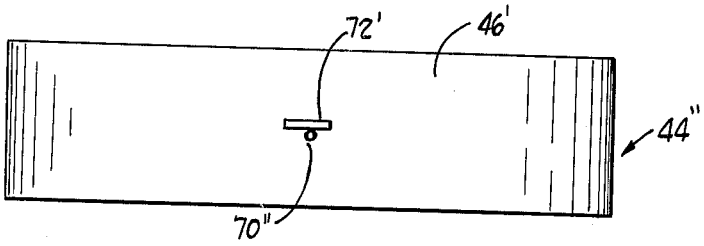
FIGS. 18, 18A and 18B are respectively top, outer side and end views of a somewhat modified fastener clip for use in the mold assembly, and illustrating thereon typical locations of strain gages and thermocouples for use in a FIG. 13 type test arrangement.
Figure 18B:
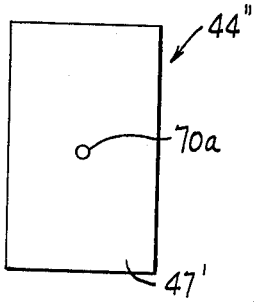
Figure 18:
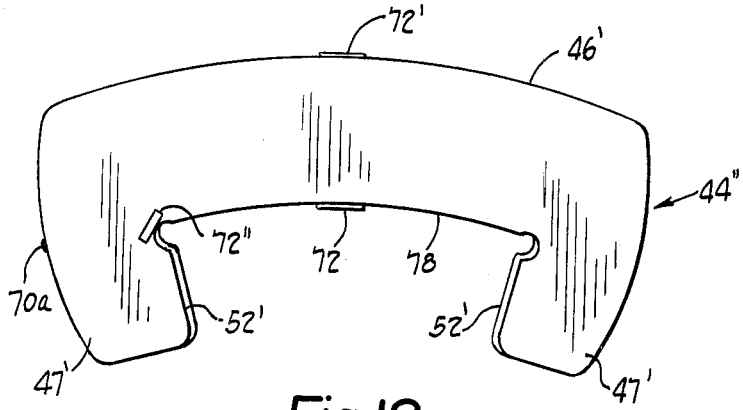
Figure 14:
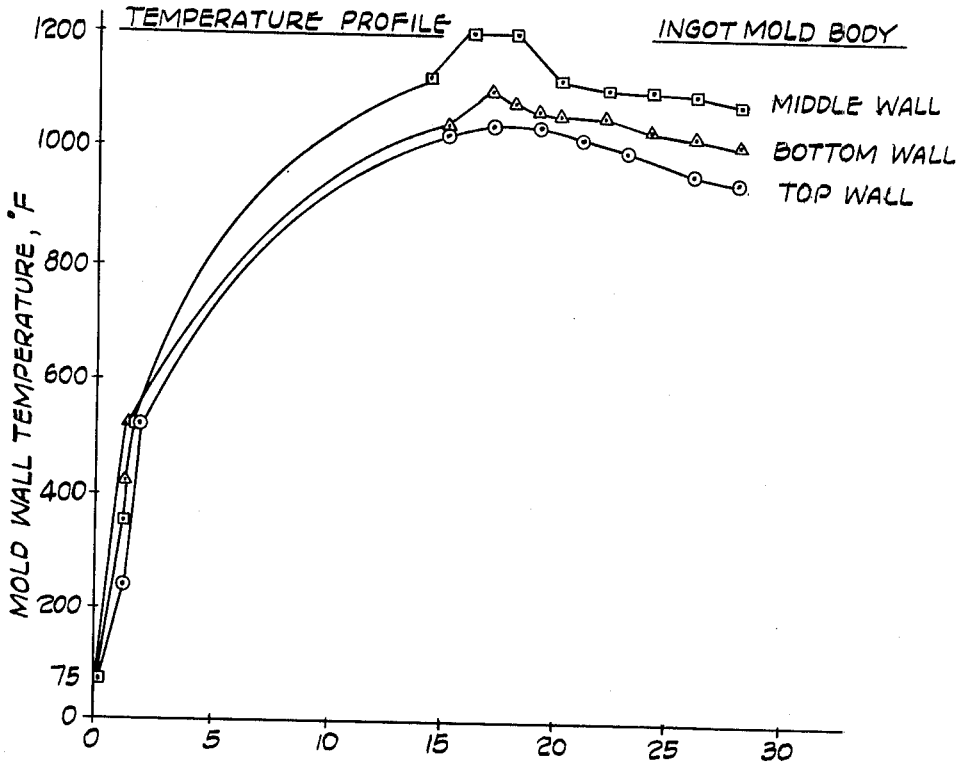
FIG. 14 is a graph illustrating the composite temperature profile for the mold wall sections, as measured by a typical mold test assembly of the FIG. 13 arrangement type.

FIGS. 18 through 18B illustrate a further modified embodiment of clip fastener 44'' for use in a mold assembly of the invention. Clip 44'' has an acruate body portion 46' and when assembled with the flanges of the mold sections will be generally spaced from engagement with the confronting surfaces 52 of the associated flanges except at the ends or corners of the confronting "inner" surface 78 of the respective clip. The arms of the clips include vertically tapered gripping faces 52' thereon, similarly to the other clip embodiments. The operation of this embodiment of clip fastener is generally similar to that of the other clip fasteners embodiments. However, this clip fastener structure provides for a lesser size and weight, as compared to the first described embodiments 44 and 44' of clip fasteners.

There was an approximately ½ hour time sequence between the aforementioned pours, and thus it will be seen that the mold of the invention can be rapidly reused in the production of ingots. The sectional mold construction and the described opening or separation of the mold wall section junctures, as aforedescribed, provide for the faster cooling of the produced ingot, and therefore the ability to more rapidly remove it from the mold assembly.

From the foregoing description and accompanying drawings it will be seen that the invention provides a novel sectional ingot mold comprising a plurality of mold sections having means thereon for coupling the mold sections together into an integral mold defining a mold cavity, for pouring an ingot, and wherein the interior mold cavity forming surfaces of the mold sections may be of a sinuous configuration. In certain embodiments of sectional mold, yieldable gasket means is disposed between confronting surfaces of the mold sections for aiding in preventing leakage of molten metal from the mold cavity during the pouring operation of an ingot. In other embodiments, fastener or coupling means holding the mold sections together as an integral mold assembly automatically compensate for expansion and retraction of the mold components, and permit separation of the mold sections relative to one another during the thermal elevation thereof, and are operable to cause the juncture surfaces of the mold sections to return to generally abutting relation after the cooling thereof.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

What is claimed is:

1. A sectional ingot mold comprising a plurality of separable metal side wall sections which when assembled define at least in part a generally vertically oriented mold cavity, means coacting on each of said sections for coupling the mold sections together, said means comprising fastener means coacting between adjacent mold sections for detachably coupling the latter together along generally vertically extending juncture surfaces, said fastener means being capable of holding said mold sections together in relative position to each other and preventing leakage of molten metal from between the mold sections, said fastener means being comprised of a metallic material posessing memory and providing automatic compensation for expansion and retraction of said mold sections relative to one another upon pouring of molten metal into the mold and the resultant heating and subsequent cooling thereof, said fastener means resisting but not preventing separation of said juncture surfaces of each mold section during said heating by initially expanding at a lesser rate as compared to the material of said mold sections and returning to substantially their original preheated size condition after the cooling thereof to cause said juncture surfaces to return to generally abutting relation.

2. A mold in accordance with claim 1 wherein each of said side wall sections comprise portions spaced vertically therealong of reduced size as compared to the remainder of the respective side wall section, said fastener means being adapted to be inserted into coaction with said reduced size portions on adjacent side wall sections and to be forced into tight coacting relation with the wider portions of adjacent side wall sections, thus urging the adjacent generally vertically extending juncture surfaces tightly together.

3. A sectional ingot mold comprising a plurality of separable metal side wall sections of the same general size and structure which when assembled define at least in part a generally vertically oriented mold cavity, means on each of said mold sections adapted for coaction with means on an adjacent section for coupling the mold sections together, said means comprising flanges on the respective mold section projecting laterally outwardly therefrom and extending continuously vertically for substantially the full height of the respective mold section, and fastener means coacting between adjacent flanges for detachably coupling adjacent mold sections together along generally vertically extending juncture surfaces, said fastener means clamping said juncture surfaces of said adjacent flanges together comprising a plurality of vertically spaced metal clips coacting in generally encompassing relation with said adjacent flanges and clamping the latter together, said clips being comprised of a metallic material possessing memory and providing automatic compensation for expansion and retraction of said mold sections relative to one another upon pouring of molten metal into the mold and the resultant heating and subsequent cooling thereof, said clips initially resisting but not preventing separation of said juncture surfaces during said heating and returning to substantially their original preheated size condition after the cooling thereof to cause said juncture surfaces to return to generally abutting relation, each of said mold sections having flat end faces comprising said vertically extending juncture surfaces and defining in part the respective one of said flanges.

4. A sectional ingot mold comprising a plurality of separable metal side wall sections which when assembled define at least in part a generally vertically oriented open topped mold cavity, means on each of said sections adapted for coaction with means on the adjacent sections for coupling the mold sections together, said means comprising fastener means coacting between adjacent sections for detachably coupling the latter together along generally vertically extending juncture surfaces, each of said sections on the interior surface thereof comprising means aiding in preventing leakage of molten metal from between the mold sections during pouring and solidification of an ingot in the mold, the last mentioned means including a sinuous configuration on the interior surface of each of said mold sections covering substantially the entire extent of said interior surface and extending lengthwise generally parallel to said vertically extending juncture surfaces for the full height of the respective mold section, whereby the exterior of the formed ingot will have a corresponding wave formation thereon, said fastener means being comprised of metallic material possessing memory and automatically compensating for expansion and retraction of said mold sections relative to one another, upon pouring of molten metal into the mold and the resultant heating and subsequent cooling thereof.

5. A sectional ingot mold comprising a plurality of separable metal side wall sections of the same general size and structure which when assembled define at least in part a generally vertically oriented mold cavity, means on each of said sections adapted for coaction with means on the adjacent section for coupling the mold sections together, said means comprising flanges on the respective mold section projecting laterally outwardly therefrom and extending continuously vertically for substantially the full height of the respective mold section, and fastener means coacting between adjacent flanges for detachably coupling adjacent mold sections together along generally vertically extending juncture surfaces, each of said sections on the interior surface thereof comprising means aiding in preventing leakage of molten metal from between the mold sections during pouring and solidification of an ingot in the mold, the last mentioned means including a sinuous configuration on the interior surface of each of said mold sections, said sinuous configuration covering substantially the entire extent of the mold cavity defining interior surface of each mold section, with said configuration extending lengthwise generally parallel to the direction of extension of said vertically extending juncture surfaces between said mold sections for the full height of the respective mold section, said fastener means clamping said adjacent flanges together and providing automatic compensation for expansion and retraction of said mold sections relative to one another upon pouring of molten metal into the mold and the resultant heating and subsequent cooling thereof, said fastener means comprising metal clips coacting with said adjacent flanges for forcing the latter together and thus holding the associated mold sections together, and wherein each of said mold sections has generally flat mitered end faces comprising said vertically extending juncture surfaces and defining in part the respective flange, each of said flanges embodying portions spaced vertically along the respective flange of reduced size compared with the remainder of the flange, said reduced size portions on adjacent flanges being, generally horizontally aligned in the assembled condition of said mold, each of said clips comprising a body portion and arm portions projecting laterally from said body portion in converging relation with respect to one another, said body portion having a generally flat surface thereon intermediate said arm portions, said arm portions being adapted to clasp said adjacent flanges therebetween, and including vertically tapered gripping faces thereon, said clips being adapted to be inserted into said reduced size portions with said arm portions encompassing said reduced size portions of said flanges and then said clips are forced into tight coacting relation with the wider portions of the adjacent flanges, with said tapered gripping faces tightly clasping said adjacent flanges and said body portion surface engaging the confronting surfaces of the respective wider portion of said adjacent flanges, said clips being comprised of material possessing memory, causing said clips to return to substantially their original preheated size condition after cooling thereof, thereby providing said automatic retraction compensation.

6. A sectional mold comprising a plurality of separable metal side wall sections which when assembled define at least in part a generally vertically oriented open topp mold cavity, means on each of said sections adapted for coaction with means on the adjacent mold section for detachably coupling said sections together, said means comprising flanges on the respective mold section projecting laterally outwardly therefrom and fastener means coacting between adjacent flanges for detachably holding adjacent mold sections together in relative position to each other, and wherein said flanges are so formed and configured for coaction with metal linkage parts comprising said fastener means, for forcing opposing mold sections together in leakage preventing relation, said fastener means being comprised of metallic material possessing memory, and automatically compensating for expansion and retraction of said mold sections relative to one another upon pouring of molten metal into the mold and the resultant heating and subsequent cooling thereof.

7. A mold in accordance with claim 6 wherein said flanges comprise portions spaced vertically therealong of reduced size as compared to the remainder of the respective flange, said fastener means being adapted to be inserted into coaction with said reduced size portions on adjacent flanges and to be forced into tight coacting relation with the wider portions of adjacent flanges, thus urging said adjacent flanges together.

8. A mold in accordance with claim 6 wherein the thickness of the side wall of each of said mold sections is substantially uniform throughout the width thereof, each of said mold sections having flat mitered end faces comprising vertically extending juncture surfaces and defining in part a respective flange, said mold being formed of four of said mold sections of the same general size and structure, each of said flanges embodying portions spaced vertically therealong of reduced size as compared with the remainder of the flange, said reduced size portions on adjacent flanges being generally horizontally aligned in the assembled condition of said mold, said fastener means comprising generally U-shaped clips clamping said adjacent flanges together and comprised of metallic material having a predetermined coefficient of thermal expansion as compared to that of the material of said mold sections, each said clips including tapered gripping faces and being adapted to be inserted into coaction with said reduced size portions and then forced into tight coacting relation with the wider portions of the adjacent flanges, with said tapered gripping faces tightly clasping said adjacent flanges for clamping said adjacent flanges together.

9. A sectional ingot mold comprising a plurality of separable metal side wall sections which when assembled define at least in part a generally vertically oriented mold cavity, means on each of said sections adapted for coaction with means on the adjacent mold section for detachably coupling said sections together, said means comprising flanges on the respective mold section projecting laterally outwardly therefrom and fastener means coacting between adjacent flanges for detachably holding adjacent mold sections together in relative position to each other, and wherein the mold cavity extends completely through the mold and wherein the assembled mold is adapted to be oriented in upright position on a base which forms the bottom of the mold cavity during the pouring operation of an ingot, said fastener means clamping said adjacent flanges together and being comprised of metallic material having a predetermined coefficient of thermal expansion as compared to that of the material of said mold sections, said fastener means possessing memory, and automatically compensating for expansion and retraction of said mold sections relative to one another upon pouring of molten metal into the mold, and the resultant heating and subsequent cooling thereof.

10. A sectional ingot mold comprising a plurality of separable metal side wall sections which when assembled define at least in part a generally vertically oriented open topped mold cavity, means on each of said sections adapted for coaction with means on the adjacent section for coupling the mold sections together, said means comprising flanges on the respective mold section projecting laterally outwardly therefrom and fastener means coacting between adjacent flanges for detachably coupling adjacent mold sections together along generally vertically extending juncture surfaces, and including means on at least certain of the mold sections providing projections adapted for facilitating lifting of the mold after pouring of the ingot and solidification thereof, said fastener means clamping said adjacent flanges together and being comprised of metallic material having a predetermined coefficient of thermal expansion as compared to the material of said mold sections, said fastener means possessing memory and automatically compensating for expansion and retraction of said mold sections relative to one another upon pouring of molten metal into the mold and during the resultant heating and subsequent cooling thereof.

11. A sectional ingot mold comprising a plurality of separable metal side wall sections which when assembled define at least in part a generally vertically oriented mold cavity, means on each of said sections adapted for coaction with means on the adjacent section for coupling the mold sections together, said means comprising flanges on the respective mold section projecting laterally outwardly therefrom and fastener means coacting between adjacent flanges for detachably coupling adjacent mold sections together along generally vertically extending juncture surfaces and wherein said sections are formed of cast iron, said flanges extending continuously vertically for substantially the full height of the respective mold section, each of said flanges embodying portions spaced vertically therealong of reduced size as compared with the remainder of the flange, said reduced size portions on adjacent flanges being generally horizontally aligned in the assembled condition of said mold, said fastener means comprising clips clamping said adjacent flanges together and being comprised of metallic material having a predetermined coefficient of thermal expansion as compared to that of the material of said mold sections, said fastener means possessing memory and automatically compensating for expansion and retraction of said mold sections relative to one another upon pouring of molten metal into the mold and the resultant heating and subsequent cooling thereof, said clips including tapered gripping faces thereon, and being adapted to be inserted into coaction with said reduced size portions of said flanges and then forced into tight coacting relation with the wider portions of the adjacent flanges, with said tapered gripping faces tightly clasping said adjacent flanges.

12. A sectional ingot mold comprising a plurality of separable metal side wall sections which when assembled define at least in part a generally vertically oriented open topped mold cavity, means coacting on each of said sections for coupling the mold sections together, said means comprising fastener means coacting between adjacent mold sections for detachably coupling the latter together along generally vertically extending juncture surfaces, said fastener means being capable of holding said mold sections together in relative position to each other and preventing leakage of molten metal from between the mold sections, said fastener means comprising clips formed of metallic material possessing memory and providing automatic compensation for expansion and retraction of said mold sections relative to one another upon pouring of molten metal into the mold and the resultant heating and subsequent cooling thereof, said fastener means resisting but not preventing separation of said juncture surfaces of each mold section during said heating and returning to substantially their original pre-heated size condition after the cooling thereof to cause said juncture surfaces to return to generally abutting relation.

13. A sectional ingot mold comprising a plurality of separable metal side wall sections of the same general size and structure which when assembled, define at least in part, a generally vertically oriented open topped mold cavity, means on each of said sections adapted for coaction with means on the adjacent section for coupling the mold sections together, said means comprising flanges on the respective mold section projecting laterally outwardly therefrom and extending continuously vertically for substantially the full height of the respective mold section, and fastener means coacting between adjacent flanges for detachably coupling adjacent mold sections together along generally vertically extending juncture surfaces, each of said sections on the interior surfaces thereof comprising means aiding in preventing leakage of molten metal from between the mold sections during pouring and solidification of an ingot in the mold and preventing leakage of molten metal from an ingot, the last mentioned means including a sinuous configuration on the interior surface of each of said mold sections, said sinuous configuration covering substantially the entire extent of the mold cavity defining interior surface of each mold section, with said configuration extending lengthwise generally parallel to the direction of extension of said vertically extending juncture surfaces between said mold sections for the full height of the respective mold section, said fastener means clamping said adjacent mold flanges together and being comprised of metallic material possessing memory, and automatically compensating for expansion and retraction of said mold sections relative to one another upon pouring of molten metal into the mold and the resultant heating and subsequent cooling thereof, said fastener means initially expanding at a lesser rate as compared to the material of said mold sections during the said heating thereof so as to resist but not prevent separation of said juncture surfaces and then expanding at a faster rate resulting in a reduction of stresses therein and upon said cooling causing said juncture surfaces to return to generally abutting relationship.

14. A mold in accordance with claim 13 wherein said fastener means comprise vertically spaced metal clips coacting with said adjacent flanges for forcing the latter together and thus holding the associated mold sections together, said clips having a higher coefficient of thermal expansion as compared to said mold sections.

15. A mold in accordance with claim 14 wherein said mold sections are formed from grey iron, and said clips are formed of stabilized austenitic stainless steel.

16. A sectional ingot mold comprising a plurality of separable metal side wall sections of the same general size and structure which when assembled define at least in part a generally vertically oriented mold cavity, means on each of said sections adapted for coaction with means on the adjacent section for coupling the mold sections together, said means comprising flanges on the respective mold section projecting laterally outwardly therefrom and extending continuously vertically for substantially the full height of the respective mold section, and fastener means coacting between adjacent flanges for detachably coupling adjacent mold sections together along generally vertically extending juncture surfaces, each of said sections on the interior surface thereof comprising means aiding in preventing leakage of molten metal from between the mold sections during pouring and solidification of an ingot in the mold and preventing leakage of molten metal from an ingot, the last mentioned means including a sinuous configuration on the interior surface of each of said mold sections, said sinuous configuration covering substantially the entire extent of the mold cavity defining interior surface of each mold section, with said configuration extending lengthwise generally parallel to the direction of extension of said vertically extending juncture surfaces between said mold sections for the full height of the respective mold section, said fastener means clamping said adjacent flanges together and providing automatic compensation for expansion and retraction of said mold sections relative to one another upon pouring of molten metal into the mold and the resultant heating and subsequent cooling thereof, said fastener means comprising metal clips coacting with said adjacent flanges for forcing the latter together and thus holding the associated mold sections together, said clips having a predetermined coefficient of thermal expansion as compared to said mold sections, and wherein each of said mold sections has generally flat mitered end faces comprising said vertically extending juncture surfaces and defining in part the respective flange, each of said flanges embodying portions spaced vertically along the respective flange of reduced size compared with the remainder of the flange, said reduced size portions on adjacent flanges being generally horizontally aligned in the assembled condition of said mold, each of said clips comprising a body portion and arm portions projecting laterally from said body portion in converging relation with respect to one another, said body portion having a generally flat surface thereon intermediate said arm portions, said arm portions being adapted to clasp said adjacent flanges therebetween, and including vertically tapered gripping faces thereon, said clips being adapted to be inserted into said reduced size portions with said arm portions encompassing said reduced size portions of said flanges and then said clips are forced into tight coacting relation with the wider portions of the adjacent flanges, with said tapered gripping faces tightly clasping said adjacent flanges and said body portion surface engaging the confronting surfaces of the respective wider portion of said adjacent flanges, said clips being comprised of material possessing memory, causing said clips to return to substantially their original preheated size condition after cooling thereof, thereby providing said automatic retraction compensation.

17. A sectional ingot mold comprising a plurality of separable metal side wall sections which when assembled, define at least in part a generally vertically oriented mold cavity, means on each of said sections adapted for coaction with means on the adjacent section for coupling the mold sections together, said means comprising flanges on the respective mold section projecting laterally outwardly therefrom and extending vertically for substantially the full height of the respective mold section, and metal fastener means coacting between adjacent flanges for detachably coupling adjacent mold sections together along generally vertically extending juncture surfaces, each of said sections on the interior surfaces thereof comprising means aiding in preventing leakage of molten metal from between the mold sections during pouring and solidification of the ingot in the mold, the last mentioned means including a sinuous configuration on the interior surface of each of said mold sections, said sinuous configuration covering substantially the entire extent of the mold cavity defining interior surface of each mold section, with said configuration extending lengthwise generally parallel to the direction of extension of said vertically extending juncture surfaces between said mold sections for the full height of the respective mold section, said fastener means clamping said adjacent mold flanges together and automatically compensating for expansion and retraction of said mold sections relative to one another upon pouring of molten metal into the mold and the resultant heating and subsequent cooling thereof, said fastener means resisting but not preventing separation of said juncture surfaces and upon said cooling causing said juncture surfaces to return to generally abutting relationship, said fastener means comprising abutments disposed on opposite sides of each of said adjacent flanges and stringer means connecting said abutments, said abutments being movable relative to said stringer means lengthwise thereof, said stringer means being adapted to hold said abutments in predetermined spaced relation with respect to one another, and resilient metallic spring means coacting between each said abutment and a confronting one of said adjacent flanges and urging said adjacent flanges together.

18. A mold in accordance with claim 17 wherein said abutments comprises vertically oriented plates supported by said stringer means, said stringer means comprising adjustable bolts extending between and coupling said plates together in spaced relation, slots in said flanges through which said bolts extend with said bolts being supportable on said flanges, said resilient spring means comprising a coil spring disposed in compressed relation between a respective one of said plates and said confronting one of said adjacent flanges, and means on the respective confronting one of said adjacent flanges coacting with said spring for locating said spring with respect to said confronting one of said adjacent flanges.

19. A sectional ingot mold comprising a plurality of separable metal side wall sections which when assembled define at least in part a generally vertically oriented mold cavity, means coacting between each of said sections for coupling the mold sections together, said means comprising fastener means coacting beween adjacent mold sections for detachably coupling the latter together along generally vertically extending juncture surfaces, said fastener means being capable of holding said mold sections together in relative position to each other and preventing leakage of molten metal from between the mold sections, said fastener means being comprised of a metallic material possessing memory and providing automatic compensation for expansion and retraction of said mold sections relative to one another upon pouring of molten metal into the mold and the resultant heating and subsequent cooling thereof, said fastener means resisting but not preventing separation of said juncture surfaces of each mold section during said heating by initially expanding at a lesser rate as compared to the material of said mold sections during said heating thereof, and then subsequently expanding at a faster rate as compared to the material of said mold sections and causing a reduction in the stresses on said fastener means, and upon said cooling causing said juncture surfaces to return to generally abutting relation.

20. A mold in accordance with claim 19 wherein said fastener means comprises metal clips coacting between adjacent mold sections, said clips being formed of stainless steel having a coefficient of thermal expansion greater than the coefficient of thermal expansion of the material of said mold sections and having a relatively low rate of thermal conductivity, and being such that after the initial pouring of molten metal into the mold and said initial expansion of said fastener means, the strain on said clips is materially reduced by said subsequent expansion at a faster rate as compared to the material of said mold side wall sections.

* * * * *

UNITED STATES PATENT AND TRADEMARK OFFICE

CERTIFICATE OF CORRECTION

PATENT NO. : 4,269,385
DATED : May 26, 1981
INVENTOR(S) : Harold M. Bowman

It is certified that error appears in the above—identified patent and that said Letters Patent is hereby corrected as shown below:

On the title page under Related U.S. Application (63), line 3, "1976" should read -- 1975 --, Column 14, line 11 "topp" should read -- topped --.

Signed and Sealed this

*Eighteenth* Day of *August 1981*

[SEAL]

*Attest:*

GERALD J. MOSSINGHOFF

*Attesting Officer*

*Commissioner of Patents and Trademarks*